US009079638B2

(12) United States Patent
Ricciardi et al.

(10) Patent No.: US 9,079,638 B2
(45) Date of Patent: Jul. 14, 2015

(54) STORAGE SYSTEM FOR A WATERCRAFT

(71) Applicants: Yamaha Motor Corporation, U.S.A., Cypress, CA (US); Yamaha Jet Boat Manufacturing U.S.A., Inc., Vonore, TN (US)

(72) Inventors: Mike Ricciardi, Marietta, GA (US); Scott Watkins, Canton, GA (US); Ed Miller, Harriman, TN (US); Thomas Griffin, Maryville, TN (US)

(73) Assignees: YAMAHA HATSUDOKI KABUSHIKI KAISHA, Shizuoka-Ken (JP); YAMAHA JET BOAT MANUFACTURING U.S.A., INC., Vonore, TN (US)

( * ) Notice: Subject to any disclaimer, the term of this patent is extended or adjusted under 35 U.S.C. 154(b) by 55 days.

(21) Appl. No.: 14/091,788

(22) Filed: Nov. 27, 2013

(65) Prior Publication Data

US 2015/0144052 A1 May 28, 2015

(51) Int. Cl.

| | |
|---|---|
| ***B63B 17/00*** | (2006.01) |
| ***B63B 29/00*** | (2006.01) |
| ***B63B 29/04*** | (2006.01) |
| ***B63H 21/36*** | (2006.01) |
| ***B63B 27/00*** | (2006.01) |

(52) U.S. Cl.

CPC ..... *B63B 29/00* (2013.01); *B63B 27/00* (2013.01); *B63B 29/04* (2013.01); *B63H 21/36* (2013.01); *B63B 2029/043* (2013.01)

(58) Field of Classification Search

CPC ..... B63B 27/00; B63B 29/00; B63B 29/04; B63H 2029/043; B63H 21/36

USPC ..... 114/201 R, 203, 361, 343, 363, 364

See application file for complete search history.

(56) References Cited

U.S. PATENT DOCUMENTS

| | | | | |
|---|---|---|---|---|
| 5,572,944 | A | 11/1996 | Slikkers et al. | |
| 6,672,240 | B1 | 1/2004 | Aube et al. | |
| 7,513,211 | B1 * | 4/2009 | Farb et al. | 114/363 |
| 8,899,169 | B1 * | 12/2014 | Jaziri | 114/363 |
| 2008/0072810 | A1 | 3/2008 | Forbes et al. | |
| 2013/0110329 | A1 | 5/2013 | Kinoshita et al. | |
| 2013/0137317 | A1 | 5/2013 | Shibayama | |

* cited by examiner

*Primary Examiner* — Daniel V Venne

(74) *Attorney, Agent, or Firm* — Rabin & Berdo, P.C.

(57) ABSTRACT

A watercraft is provided. The watercraft includes a cockpit. The watercraft further includes a stern-facing seat having a movable backrest. The seat is outside of the cockpit. An aquatic activity platform extends to a stern of the watercraft from the seat, and defines a foot rest for the seat. An engine is positioned substantially further towards a bow of the watercraft than the seat. A storage compartment has an opening positioned further towards the bow than the backrest of the seat. The backrest is movable to a first position to expose the opening and provide access to the storage compartment, and to a second position to conceal the opening.

20 Claims, 7 Drawing Sheets

STORAGE SYSTEM FOR A WATERCRAFT

BACKGROUND

1. Technical Field

The present invention relates to the field of watercrafts.

2. Background Information

Watercrafts (e.g., boats) are used for many purposes. In some cases a storage area is formed in the watercraft for storing equipment and items. What is needed is an improved storage area for a watercraft.

SUMMARY

A watercraft is provided. The watercraft includes a cockpit. The watercraft further includes a stern-facing seat having a movable backrest. The seat is outside of the cockpit. An aquatic activity platform extends to a rear of the watercraft from the seat and defines a foot rest for the seat. An engine is positioned substantially further towards a bow of the watercraft than the seat. A storage compartment has an opening positioned behind the further towards the bow than the seat. The backrest is movable to a first position to expose the opening and provide access to the storage compartment, and to a second position to conceal the opening.

BRIEF DESCRIPTION OF DRAWINGS

Example embodiments will be more clearly understood from the following brief description taken in conjunction with the accompanying drawings. The accompanying drawings represent non-limiting, example embodiments as described herein.

Figure 1:
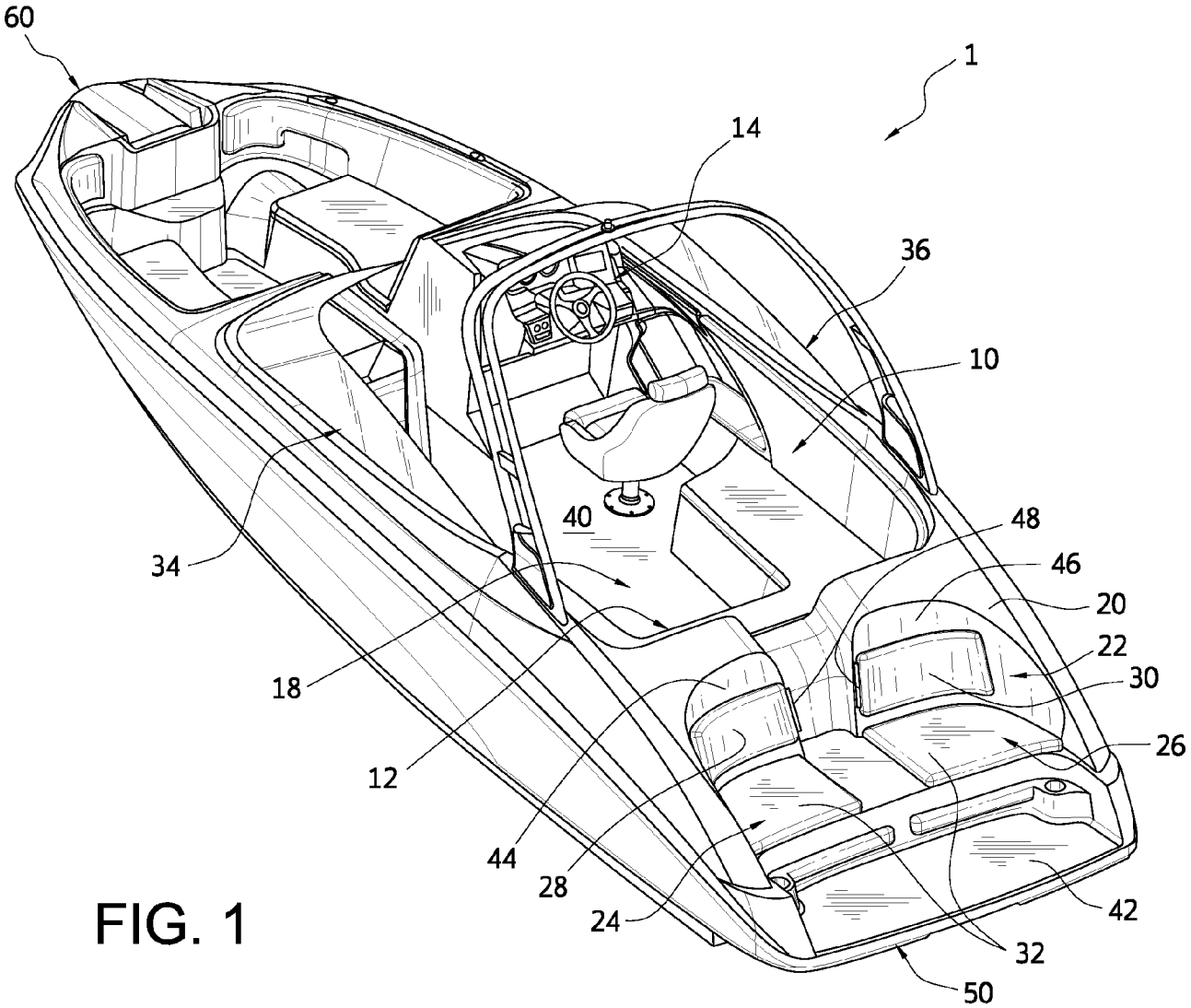
FIG. 1 illustrates a watercraft according to some embodiments of the present invention.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION

Example embodiments of the inventive concepts will now be described more fully with reference to the accompanying drawings, in which example embodiments are shown. Example embodiments of the inventive concepts may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. Like reference numerals in the drawings denote like elements, and thus their description will be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein the term "and/or" includes any and all combinations of one or more of the associated listed items. Other words used to describe the relationship between elements or layers should be interpreted in a like fashion (e.g., "between" versus "directly between," "above" versus "directly above," "below" versus "directly below "adjacent" versus "directly adjacent," "on" versus "directly on").

It will be understood that, although the terms "first", "second", etc. may be used herein to describe various elements, components, regions, layers, positions and/or sections, these elements, components, regions, layers, positions and/or sections should not be limited by these terms. These terms are only used to distinguish one element, component, region, layer, position or section from another element, component, region, layer, position or section. Thus, a first element, component, region, layer, position or section discussed below could be termed a second element, component, region, layer, position or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Example embodiments of the inventive concepts are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments of the inventive concepts should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

A watercraft (e.g., a boat) may be used during aquatic activities such as recreational cruising, skiing or tubing. Some watercrafts may include a cockpit. The cockpit may be a semi-enclosed area, spanning from controls (e.g., steering mechanism, etc.) of the watercraft to an engine compartment of the watercraft.

The watercraft may also include a stern-facing seat disposed outside the cockpit. A user may prepare for aquatic activities (e.g. swimming, fishing, wake boarding, water skiing, tubing, etc.) on the stern-facing seat. An aquatic activity platform may also be provided. The aquatic activity platform may be proximate the stern-facing seat and serve as a foot rest for the stern-facing seat. The aquatic activity platform may be closer to the water than other parts of the seat (e.g., backrest, sitting part with a sitting surface, etc.) so that a user may easily enter the water from the aquatic activity platform.

During the course of discovering the present invention, the inventors realized that an improved storage system is desirable. For instance, the user may need to bring their aquatic equipment from a cockpit of the watercraft to the stern-facing seat, and then prepare for the aquatic activity while sitting on the stern-facing seat. Carrying aquatic equipment out of the cockpit may be cumbersome and dangerous, especially if the user is carrying an excessive amount of equipment or if the cockpit and the aquatic activity platform are wet.

Thus, to minimize the distance that equipment is transported, it may be desirable to include a storage compartment disposed proximate the aquatic activity platform and the stern-facing seat so a user may prepare themselves for aquatic activities in this general area, and without the need to enter the cockpit to access the storage compartment. Such a storage compartment may be formed behind the stern-facing seat. The storage compartment may have an opening that is positioned further toward a bow of the watercraft than the stern-facing seat. The stern-facing seat may include a movable backrest. The movable backrest may be moved to access the storage compartment, or conceal the storage compartment.

A user may store aquatic equipment in the storage compartment. Thus, a user may not need to carry aquatic equipment from the cockpit. Instead, the aquatic equipment may be stored in the storage compartment and near the aquatic activity platform where the user intends on entering the water to engage in aquatic activities.

An engine may also be positioned substantially further towards the bow of the watercraft than the seat. By doing so, space surrounding the engine may be utilized to form the storage compartment, thereby increasing the utility of the surrounding space. The engine may also be positioned beneath the storage compartment to further increase the utilization of the surrounding space.

The storage compartment may also serve several functions as the storage compartment may be disposed proximate the engine. For instance, conduits and apertures may connect an engine compartment, which the engine is disposed within, to the storage compartment. Through the storage compartment, fresh air may be brought into the engine compartment while engine fumes may be drawn out from the engine compartment.

Figure 2:
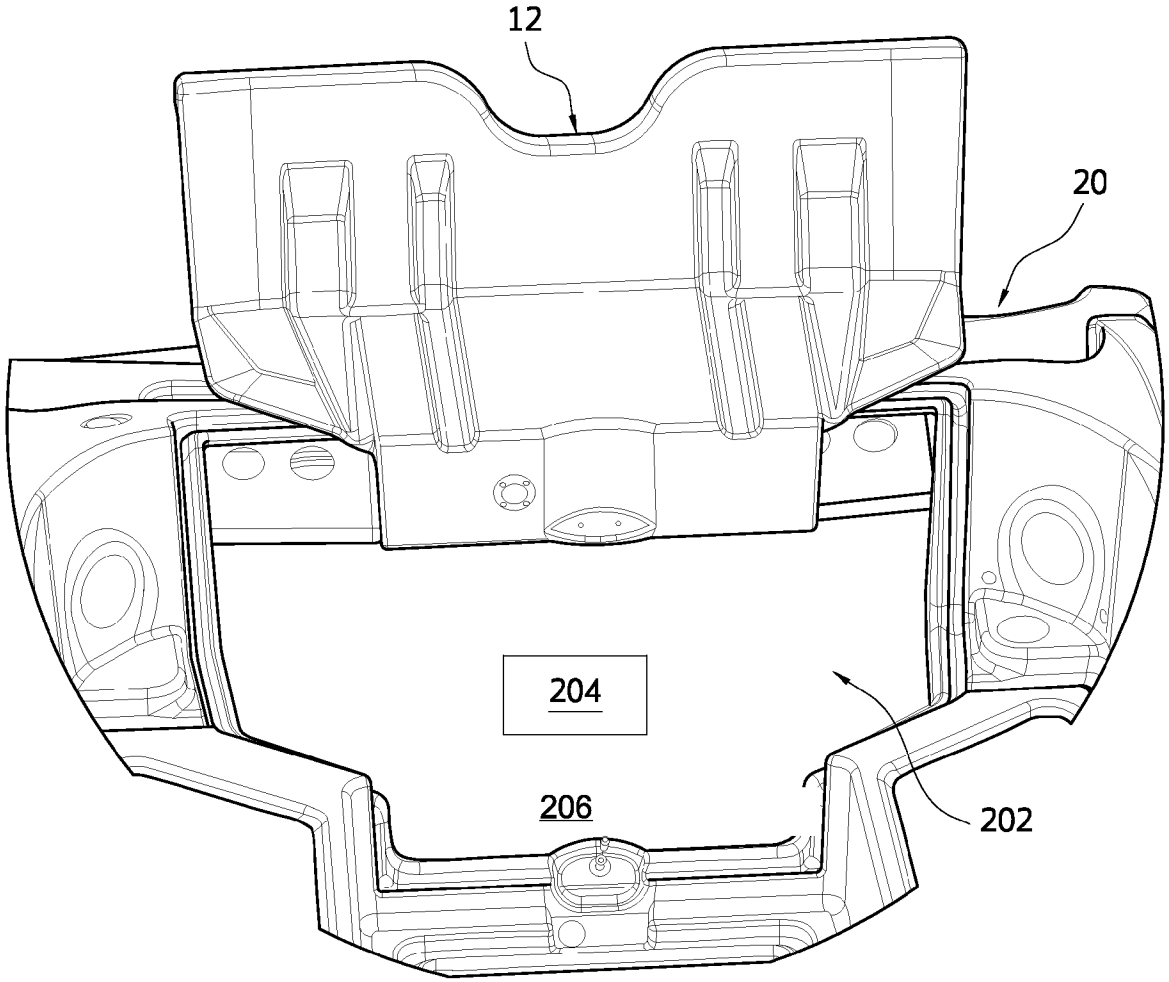
FIG. 2 illustrates an engine compartment of the watercraft according to some embodiments of the present invention.

FIGS. 1-2 illustrate some embodiments of the present invention. FIG. 1 illustrates a watercraft 1, and FIG. 2 illustrates a stern-facing view of a part of the watercraft 1. The watercraft 1 includes a motor which may be an engine 204. For simplicity in FIG. 2, the engine 204 is illustrated as a box, but the engine 204 is shown in greater detail in FIG. 3. The watercraft 1 includes an engine hatch 12 which covers the engine 204. In some embodiments, the engine hatch 12 is movable between different positions so as to prevent access to the engine 204 in a first position (i.e., a closed position), and allow access to the engine 204 in a second position (i.e., an open position). In this aspect of the invention, the engine 204 is accessible from a cockpit 10.

The watercraft 1 includes controls 14 which control operations of the watercraft 1. These operations may include, but are not limited to, steering of the watercraft 1, speed of the watercraft 1, actuation of the engine 204 and operation of blowers 806, 808. Operation of the blowers 806, 808 is discussed below and with reference to FIG. 8.

The watercraft 1 includes the cockpit 10. The cockpit 10 may extend from the engine hatch 12 to controls 14, and may also span from the port side 34 of the watercraft 1 to starboard side 36 of the watercraft 1.

As discussed above, the engine hatch 12 may be moved to access the engine 204. In some embodiments, the engine hatch 12 may be formed as part of a forward facing seating area 18. The forward facing seating area 18 may include seating for users on the watercraft 1. When users are seated on the forward facing seating area 18, users may face forward. The engine hatch 12 may also be a seat of the forward facing seating area 18.

The engine hatch 12 may be moved from a first position (i.e., a closed position), where the engine hatch 12 serves as a seat for a user, to a second position (i.e., an open position) where the engine hatch 12 gives access to an engine compartment 202 containing the engine 204. In the first position of the engine hatch 12, an opening 206 of the engine compartment 202 may be concealed so that the engine 204 cannot be accessed by a user. In the second position of the engine hatch 12, the opening 206 of the engine compartment 202 may be exposed to provide access to the engine 204. In the second position of the engine hatch 12, the opening 206 of the engine compartment 202 may be towards a bow 60 of the boat 1.

In some embodiments, in the first position of the engine hatch 12, the engine 204 cannot be accessed from the cockpit 10. Further, in some embodiments, in the second position of the engine hatch 12, the engine hatch 12 does not serve as a seat for any user.

In some embodiments, the engine hatch 12 is pivotable upward and downward so as to move between the first and second positions of the engine hatch 12. The second position of the engine hatch 12 is illustrated in FIG. 2. FIG. 2 is a view from the cockpit 10 facing towards a stern 50 of the watercraft 1. As illustrated, the engine hatch 12 is pivoted upward and away from a deck 40 of the watercraft 1 to reach the second position and thereby give access to the engine compartment 202 that stores the engine 204. To close the engine compartment 202, the engine hatch 12 may need to be pivoted downward and toward the deck 40 to reach the first position. The first position of the engine hatch 12 is illustrated in FIG. 1.

While the engine hatch 12 has been described as being pivotable upward and downward, the engine hatch 12 may be modified to move in any direction so long as the engine compartment 202 may be accessed and closed through the different positions and movements of the engine hatch 12. In some embodiments, the engine hatch 12 is disposed only in the cockpit 10. In some embodiments, a rearward-most part of the engine hatch 12 (the part of the engine hatch 12 that is disposed closest to the stern 50) forms the rearward-most part of the cockpit 10.

In some embodiments, the engine hatch 12 may include cushions. By including cushions, the engine hatch 12 may allow a user to sit comfortably thereupon when the engine hatch 12 is in the first position (i.e., when the engine compartment 202 is closed by the engine hatch 12).

As illustrated in FIG. 1, a divider 20 is positioned between the cockpit 10 and a stern-facing seating area 22. A user sitting on the stern-facing seating area 22 may face towards the stern 50. The divider 20 may serve as a wall at least partially enclosing the cockpit 10 and separating the cockpit 10 from the stern-facing seating area 22. The stern-facing seating area 22 includes port and starboard seats 24, 26 that are each stern-facing and disposed on opposite sides of the watercraft 1. The divider 20 may have a part of the engine compartment 202 and/or engine hatch 12 formed therein. As illustrated, the stern-facing seating area 22 may be disposed outside the cockpit 10 and face towards the stern 50 of the watercraft 1.

In some embodiments, the divider 20 may have a gap disposed between starboard and port sides of the divider 20 so that a user may easily move between the stern-facing seating area 22 and the cockpit 10. In some embodiments, the gap may extend between through the entire height of the divider 20.

Figure 3:
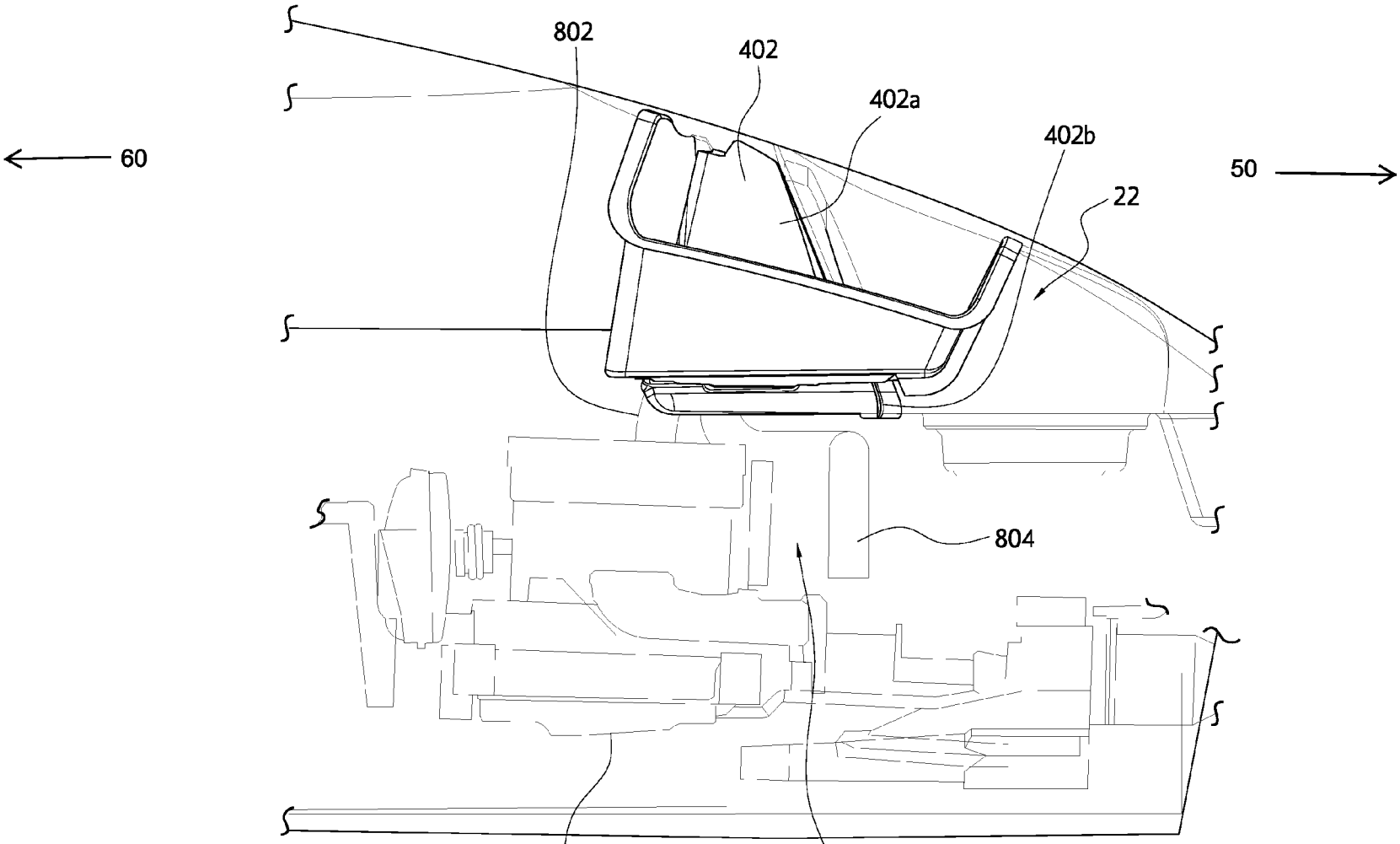
FIG. 3 illustrates a partial side view of a stern of the watercraft according to some embodiments of the present invention.

FIG. 3 illustrates a side view of a rear portion of the watercraft 1 with some elements omitted for clarity. The bow 60 is on the left of the figure, and the stern 50 is on the right of the figure. The engine 204 may disposed further towards bow 60 of the watercraft 1 than the stern-facing seating area 22. Moreover, a top-most part the engine 204 may be directly beneath the bottom-most part of a port storage compartment 402 (described below). While not illustrated, the top-most part of the engine 204 may also be directly beneath the lowermost part of a starboard storage compartment 404. The starboard storage compartment 404 (although not illustrated in FIG. 3) may be oriented similarly as port storage compartment 402.

With reference back to FIG. 1, an aquatic activity platform 42 may be provided. The aquatic activity platform 42 may serve as a foot rest for the port and starboard seats 24, 26. The aquatic activity platform 42 may extend aft from the port and starboard seats 24, 26. In some embodiments, the aquatic activity platform 42 may form the stern 50 of the watercraft 1. In some embodiments, the aquatic activity platform 42 is formed integrally with the port and starboard seats 24, 26.

The aquatic activity platform 42 may also serve as a staging area for aquatic activities. For instance, if a user wishes to enter the water, they may first prepare themselves on the port and starboard seats 24, 26 for such aquatic activities. Then, the user may enter the water from the aquatic activity platform 42. The aquatic activity platform 42 may be proximate the water (just slightly above the waterline) to facilitate the user's entry into the water. Further, the aquatic activity platform 42 may be free of barriers or walls in a direction from the port and starboard seats 24, 26 to the water.

Figure 4:
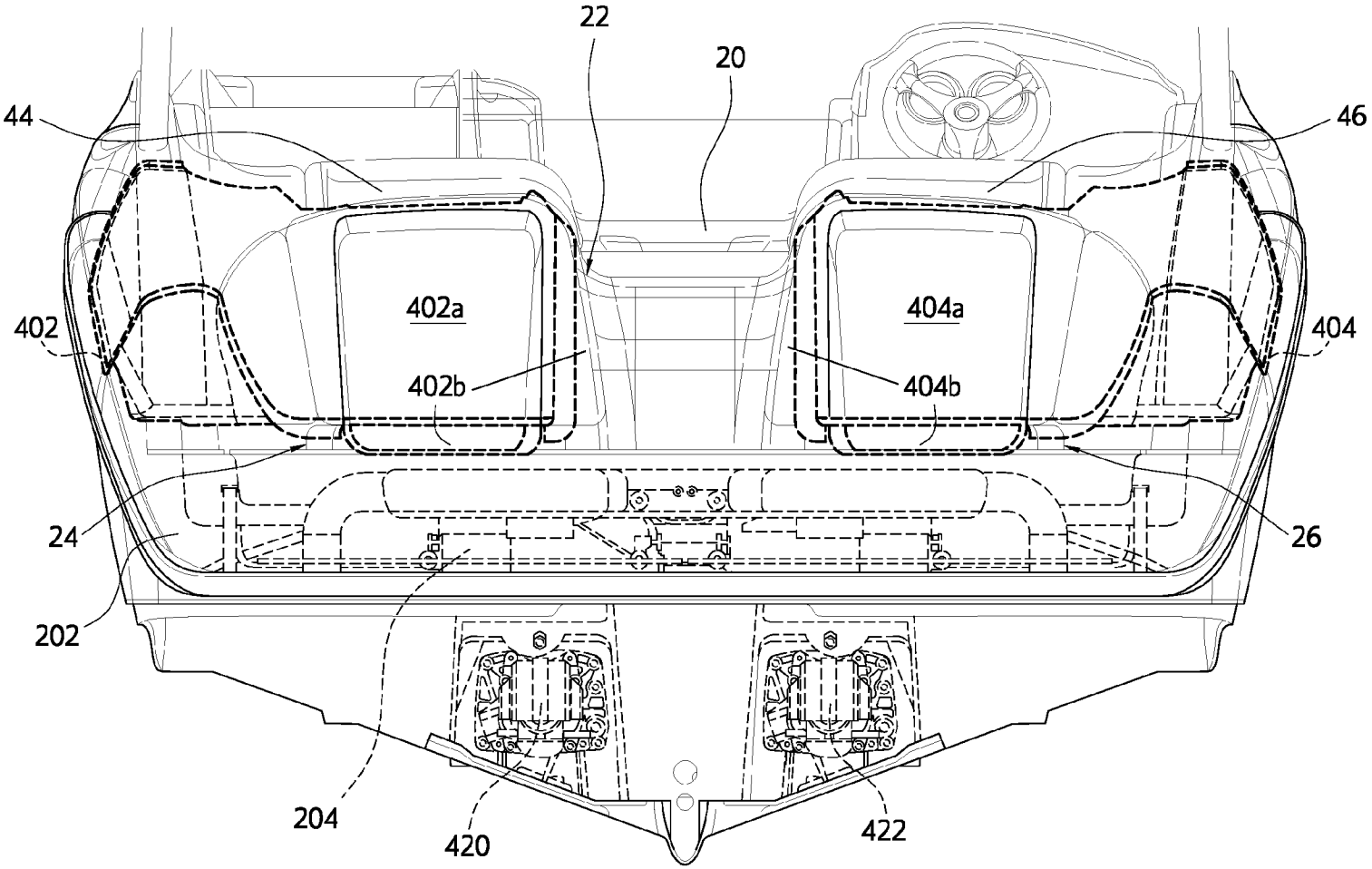
FIG. 4 illustrates a view from the stern of the watercraft according to some embodiments of the present invention.

FIG. 4 illustrates a view from the stern 50 of the watercraft 1 facing toward the bow 60 of the watercraft 1. Some parts of the watercraft 1 have been omitted from FIG. 4 so as to illustrate the relative positions of the port and storage compartments 402, 404 and engine 202, more clearly. The port and storage compartments 402, 404 are described below. Port and starboard backrests 28, 30 of the stern-facing seating area 26 are omitted merely for clarity and so as to more clearly illustrate other components. During use and operation, the port and starboard backrests 28, 30 would be included.

In some embodiments, the watercraft 1 may operate through the use of propulsion units 420, 422. The propulsion units 420, 422 may propel the watercraft 1 and control a speed thereof. In some embodiments, water is pressurized by jet pumps of the propulsion units 420, 422 to increase velocity, and then the water exits through jet pump reduction nozzles that direct water flow. The propulsion units 420, 422 may include impellers that are housed internally and within housings of the propulsion units 420, 422.

In some embodiments the propulsion units 420, 422 have a smooth outer surface. By doing so, the possibility of a user hurting themselves on jagged edges may be decreased. In some embodiments, the housings of the propulsion units 420, 422 are formed so as to not include jagged and sharp edges which may hurt a user. A user entering the water from the aquatic activity platform 42 may avoid being hurt by exposed blades through the use of propulsion units 420, 422 as described above. The activity platform 42 may extend further aft than the propulsion units 420, 422 such that a part of the activity platform 42 forms the stern 50 of the watercraft 1 and covers the propulsion units 420, 422.

As illustrated in FIG. 1, in some embodiments, the port and starboard seats 24, 26 may have port and starboard backrests 28, 30, as well as a sitting area 32. The port and starboard seats 24, 26 may include surrounding walls 44, 46 that surround and enclose the backrests 28, 30. In some embodiments, each of the port backrest 28, starboard backrest 30 and sitting areas 32 has a cushion (such as cushion 602 illustrated in FIG. 6) to allow a user to rest comfortably thereupon. The sitting area 32 may be a sitting part for a user to sit upon. The port and starboard backrests 28, 30 may each serve as a movable backrest for users.

Figure 5:
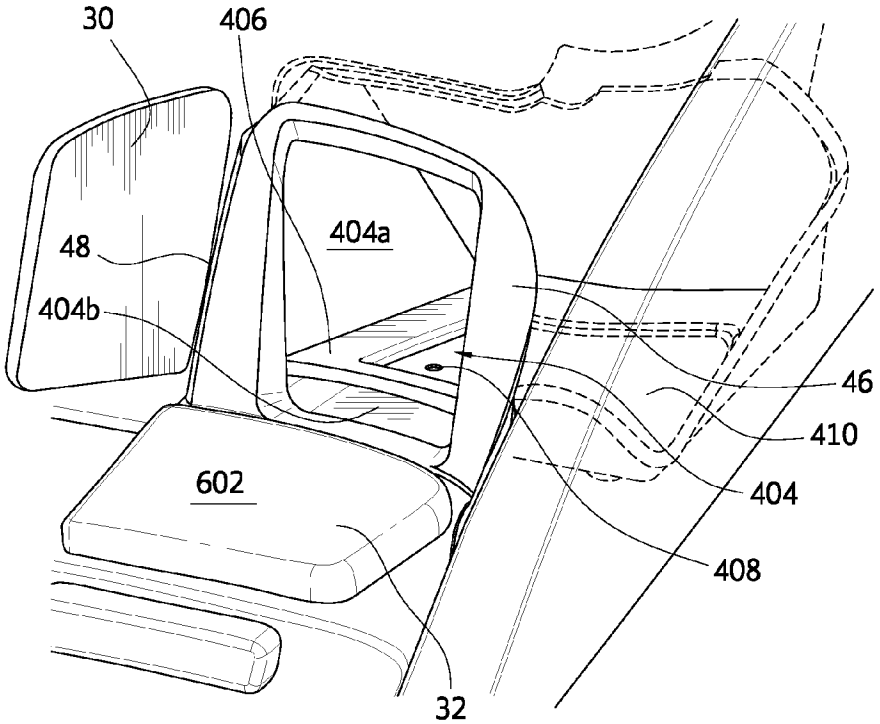
FIG. 5 illustrates a storage compartment according to some embodiments of the present invention.

As illustrated in FIGS. 1 and 5, the port and starboard storage compartments 402, 404 may be behind the port and starboard seats 24, 26 respectively. In other words, the port and starboard storage compartments 402, 404 are disposed further towards the bow 60 of the boat 1 than the port and starboard seats 24, 26. Further, the port and starboard storage compartments 402, 404 are selectively concealed and opened according to operations of the port and starboard seats 24, 26.

In some embodiments, the port and starboard storage compartments 402, 404 may be disposed directly behind the port and starboard backrests 28, 30 respectively so as to be further towards the bow 60 than the port and starboard backrests 28, 30. In some embodiments, the port and starboard storage compartments 402, 404 may be disposed within the divider 20 and enclosed by the divider 20.

In some embodiments, the port and starboard backrests 28, 30 may be movable relative to other parts of the port and starboard seats 24, 26. In some embodiments, the port and starboard backrests 28, 30 may be movable relative to surrounding walls 44, 46 of the port and starboard seats 24, 26 so as to expose and conceal port and starboard storage compartments 402, 404.

The surrounding walls 44, 46 may form walls of the port and starboard storage compartments 402, 404. The surrounding walls 44, 46 may form an apertures (e.g., aperture 406 discussed below), of the port and starboard storage compartments 402, 404, that the port and starboard backrests 28, 30 may conceal and expose so as to access and conceal the port and starboard storage compartments 402, 404. As used herein, accessing each of the port and starboard storage compartments 402, 404 may mean that each of the port and starboard storage compartments 402, 404 is uncovered by the respective port and starboard backrests 28, 30 so that equipment (e.g., snorkel, fishing pole, flipper, etc.) may be moved in and out of the port and storage compartments 402, 404. In some embodiments, when the port and starboard backrests 28, 30 expose the port and starboard storage compartments 402, 404, the entire port and starboard storage compartments 402, 404 may be directly accessible by a user's appendages.

When the port and starboard backrests 28, 30 conceal the port and starboard storage compartments 402, 404, the surrounding walls 44, 46 may surround and enclose portions of the port and starboard backrests 28, 30 that are disposed further towards the bow 60 than other parts of the port and starboard backrests 28, 30. By doing so, the port and starboard backrests 28, 30 may be firmly held in place by the surrounding walls 44, 46. The port and starboard backrests 28, 30 may fit into the surrounding walls 44, 46 so as to touch the surrounding walls 44, 46 and remain in a position to conceal the port and starboard storage compartments 402, 404 through friction between the port and starboard backrests 28, 30 and the surrounding walls 44, 46. A user may need to apply a sufficient force to overcome such friction to move the port and starboard backrests 28, 30 and expose the port and starboard storage compartments 402, 404.

In some embodiments, cushions may be disposed on each of the port and starboard backrests, 28, 30 and the surrounding walls 44, 46 so that when the port and starboard backrests, 28, 30 move, the cushions on the port and starboard backrests, 28, 30 move relative to cushions on the surrounding walls 44, 46.

In some embodiments, inner walls of the surrounding walls 44, 46 serve as upper walls of the storage compartments 402, 404. The port and starboard backrests 28, 30 may be independently movable of each other and relative to surrounding walls 44, 46. The port and starboard backrests 28, 30 may each also be independently movable of the engine hatch 12.

The starboard storage compartment 404 and starboard seat 26 are discussed in detail below. The port storage compartment 402 and the port seat 24 may be formed and operated similarly to the starboard storage compartment 404 and the starboard seat 26, and so the following discussion also applies to the port storage compartment 402 and the port seat 24.

With reference to FIGS. 1 and 4-5, the starboard backrest 30 may be movable so that in a first position of the starboard backrest 30, an opening 406 of the starboard storage compartment 404 is exposed to provide access to the storage compartment 404. The opening 406 may be formed by the surrounding wall 46. When the opening 406 is exposed by the starboard backrest 30, the opening 406 may face towards the stern 50 of the boat 1; in contrast when the engine hatch 12 is in the second position to expose the opening 206 of the engine compartment 202, the opening 206 faces towards the bow 60 of the boat 1. While the storage compartment 404 and openings 206, 406 are not illustrated in FIG. 3, one may nevertheless understand that based upon the foregoing and that the storage compartment 404 may be oriented similarly to the storage compartment 402 in FIG. 3, the opening 206 would face to the left (i.e., towards the bow 60) while the opening 406 would face to the right (i.e., to the stern 50).

The starboard backrest 30 may also be movable between the first position thereof, where the opening 406 is exposed, to a second position to conceal the opening 406. FIG. 5 illustrates the first position of the starboard backrest 30, while FIG. 1 illustrates the second position of the starboard backrest 30.

The starboard backrest 30 may pivot about a pivot point 48. The pivot point 48 may comprise a hinge which is coupled with both the starboard surrounding wall 46 and the starboard backrest 30. However, any suitable fastening mechanism may be used in place of a hinge so long as the starboard backrest 30 may move to each of the first and second positions of the starboard backrest 30. The starboard backrest 30 may move towards and away from a longitudinal axis, or roll axis, of the watercraft 1. In some embodiments, rather than being pivotably attached to the pivot point 48, the starboard backrest 30 may be completely removable from the starboard seat 26 and the surrounding wall 46 to move from the second position of the starboard backrest 30 to the first position of the starboard backrest 30.

In the second position of the starboard backrest 30, the pivot point 48 is disposed closer to the longitudinal axis of the watercraft 1 than the starboard backrest 30. The starboard backrest 30 is movable so as to pivot towards the longitudinal axis of the watercraft 1 and into the first position of the starboard backrest 30. In the first position of the starboard backrest 30, the starboard backrest 30 becomes closer to the longitudinal axis of the watercraft 1 than the pivot point 48.

The starboard storage compartment 404 includes a storage area 404*a* and a drainage area 404*b*. As illustrated in FIG. 4, the drainage area 404*b* may be continuous so as to have a part underneath the storage area 404*a*, and a part side-by-side and equal in height to the storage area 404*a*. In some embodiments, aquatic equipment (e.g., snorkel, flipper, paddle, etc.) may be stored in the storage area 404*a*. The storage area 404*a* may be disposed directly above drainage area 404*b*.

When the starboard backrest 30 conceals the storage compartment 404 (i.e., the starboard backrest 30 is in the second position), the storage area 404*a* may be inaccessible to a user. In other words, a user that is in the stern-facing seating area 22 cannot access the storage area 404*a* when the starboard backrest 30 conceals the storage compartment 404.

The storage area 404*a* may include a bottom wall 410. The bottom wall 410 may be a supporting wall for supporting equipment thereupon. The storage area 404*a* may include a storage section to store equipment and miscellaneous items. The storage section may include all of the storage area 404*a* that is disposed above the bottom wall 410.

A drainage hole 408 may be formed in the bottom wall 410 of the storage area 404*a*. The drainage hole 408 may penetrate through the bottom wall 410 and to a top of the drainage area 404*b* so as to be in fluid communication with both of a storage section of the storage area 404*a* disposed above the bottom wall 410, and the drainage area 404*b*. The drainage hole 408 may be disposed directly above the drainage area 404*b*. Thus, liquids, such as water, may be communicated from the storage area 404*a* to the drainage area 404*b* via the drainage hole 408. As explained below, drainage area 404*b* may then drain any liquids therein to an outside of the storage compartment 404. The drainage area 404*b* may be in fluid communication with an outside of the watercraft 1. While only one drainage hole 408 is illustrated, several drainage holes 408 may be included.

Figure 7:
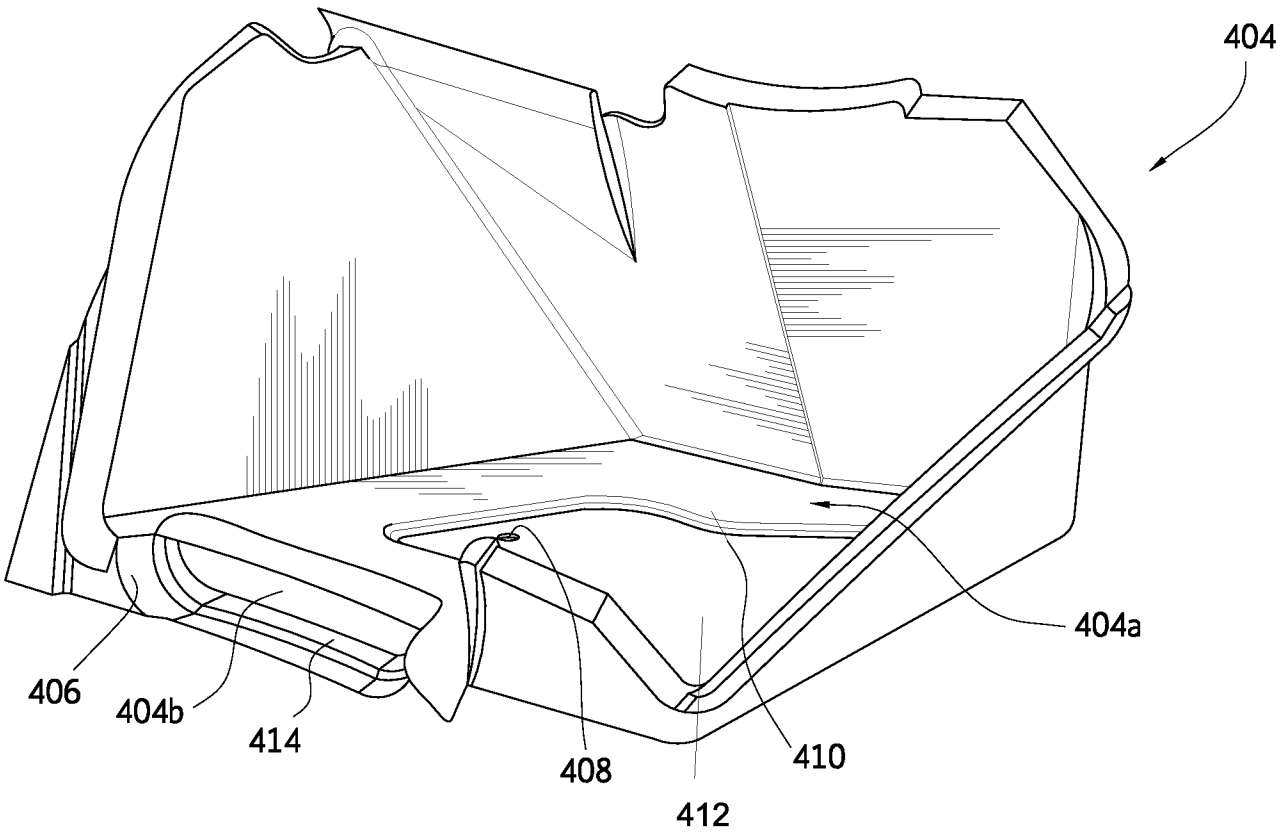
FIG. 7 illustrates a storage compartment according to some embodiments of the present invention.

FIG. 7 illustrates the storage compartment 404 in some embodiments of the present invention. As illustrated in FIG. 7, the bottom wall 410 of storage area 404*a* may include a depression 412. The depression 412 is in the bottom wall 410 and has the drainage hole 408 disposed therewithin. The depression 412 may accumulate liquid therein, and communicate such liquid to the drainage hole 408. The depression 412 may be inclined relative to the horizontal (i.e., horizontal direction), with the drainage hole 408 being at a bottom-most part of the depression 412 so as to allow fluids to flow through the force of gravity to the drainage hole 408.

When disposed in the watercraft 1, the storage compartment 404 may be surrounded by parts of the watercraft 1 so that parts (e.g., surrounding wall 46) of the watercraft 1 form top and side walls of the storage compartment 404. However, it is possible to form the storage compartment 404 so that the storage compartment 404 includes top and side walls before being placed in the watercraft 1 so that the storage compartment walls 404 are integrally formed.

Figure 6:
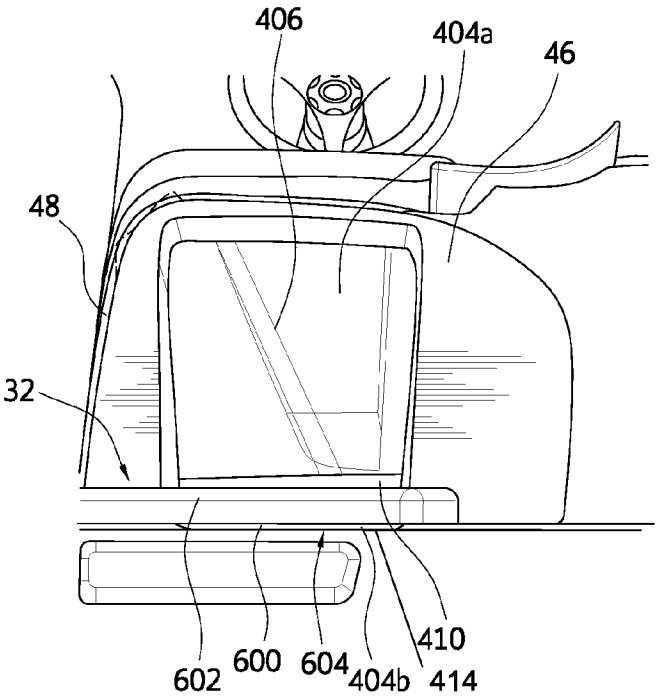
FIG. 6 illustrates a storage compartment according to some embodiments of the present invention.

FIG. 6 illustrates a view of FIG. 5 in a direction from the stern 50 to the bow 60 of the watercraft 1. In FIGS. 6 and 7, the sitting area 32 may include a cushion 602. A bottom-most part 414 the drainage area 404*b* may be below a bottom-most part 600 of the cushion 602, and above or level with a sitting surface 604 of the sitting area 32. By having a bottom-most part 414 of the drainage area 404*b* disposed above or level with the sitting surface 604 of the sitting area 32, the drainage area 404*b* may properly drain, since liquid inside the drainage area 404*b* will not be trapped inside the drainage area 404*b* by the sitting area 32. Furthermore, by having a bottom-most part the drainage area 404*b* below a bottom-most part 600 of the cushion 602, the drainage area 404*b* may properly drain, since liquid inside the drainage area 404*b* will not be trapped inside the drainage area 404*b* by the cushion 602. Cushion 602 may be omitted, and a user may sit directly on the sitting surface 604, which is also the top surface of the sitting area 32 in such embodiments. In some embodiments, in a direction extending aft, the bottom surface of the bottom part 414 and the sitting surface 604 together form a surface that is consistently angled downward.

A clearance may be provided between the starboard backrest 30 and the drainage area 404*b*. By providing the clearance, fluids may drain more easily from the drainage area 404*b* as the drainage area 404*b* will not be completely covered by the starboard backrest 30. In some embodiments, part of the drainage area 404*b* may not be covered by the starboard backrest 30 when the starboard backrest 30 is in the second position. In some embodiments, a bottom-most part of the starboard backrest 30 is disposed above bottom-most part 414 of the drainage area 404*b*. In some embodiments, in the second position of the starboard backrest 30, the starboard backrest 30 may completely cover the storage area 404*a* so that no part of the storage area 404*a* is exposed and accessible to a user, but not completely cover the drainage area 404*b*.

As illustrated FIG. 7, a bottom surface of the bottom-most part 414 may be inclined relative to the horizontal so that liquids in the drainage area 404*b* flow under the force of gravity towards an outside of the drainage area 404*b* and towards the opening 406 of the storage compartment 404. From the opening 406, liquids exit the drainage area 404*b*.

The above structure may prove to be convenient when storing aquatic equipment. In one example, water from the aquatic equipment may flow from the storage area 404*a* to the drainage area 404*b* via the drainage hole 408. From the drainage area 404*b*, water may flow outside the drainage area 404*b* and starboard storage compartment 404 because of the incline of the bottom-most part 414. The flow of water from the aquatic equipment to an outside of the drainage area 404*b* may occur under the force of gravity, thereby obviating the need for complicated mechanical components for actively pumping and draining water from the storage and drainage areas 404*a*, 404*b*. This may reduce the accumulation of water in the storage and drainage areas 404*a*, 404*b*, and allow aquatic equipment as well as the storage and drainage areas 404*a*, 404*b* to dry. While water was described in the above example, any liquid may be similarly drained through the storage and drainage areas 404*a*, 404*b*.

With reference to FIG. 5 the starboard storage compartment 404 may be L-shaped. The starboard storage compartment 404 may increase in length (the length may be measured along lines parallel to the longitudinal axis of the watercraft 1) with increasing distance from the longitudinal axis of the watercraft 1. Thus, the starboard storage compartment 404 may utilize spaces which may conventionally be empty or unused. The starboard storage compartment 404 size may be further increased by being disposed directly above the engine 204 and the engine compartment 202, as this space may often times also be unused or empty.

As discussed above, the engine compartment 202 and starboard storage compartment 404 are accessed through different mechanisms. For instance, the engine hatch 12 may be used to access the engine compartment 202, while the starboard backrest 30 may be used to access starboard storage compartment 404. By having different mechanisms for accessing the starboard storage compartment 404 and the engine compartment 202, the mechanisms may be formed smaller and have a less cumbersome operation than if the storage compartment 404 and engine compartment 202 were accessed through the same mechanism. Accordingly, the engine hatch 12 and the starboard backrest 30 may be formed to be smaller and less cumbersome than in a situation where only one large opening is provided to access both the storage compartment 404 and the engine compartment 202. Since the starboard backrest 30 may be substantially smaller and easier to move than engine hatch 12, a user may access the storage compartment 404 without having to lift a heavy engine cover (such as engine hatch 12). Also, by having different mechanisms for accessing the starboard storage compartment 404 and the engine compartment 202, a user may be prevented from coming into contact with moving engine parts and hurting themself.

Furthermore, in some embodiments the engine compartment 202 is only accessed through operation of the engine hatch 12, and the starboard storage compartment 404 is only accessed through the starboard backrest 30. In other words, the engine compartment 202 cannot be accessed by a user through the starboard storage compartment 404 and vice-versa. By keeping the storage compartment 404 separate from the engine compartment 202, liquids from the storage compartment 404 may be prevented from entering the engine compartment 202.

The operation and structure of the starboard stern storage compartment 404 and the starboard seat 26 were discussed above. The port storage compartment 402 and port seat 24 may be formed and operate similarly to the stern storage compartment 404 and starboard seat 26, and so the above discussion also illustrates the operation and structure of the port storage compartment 402 and port seat 24.

Figure 8:
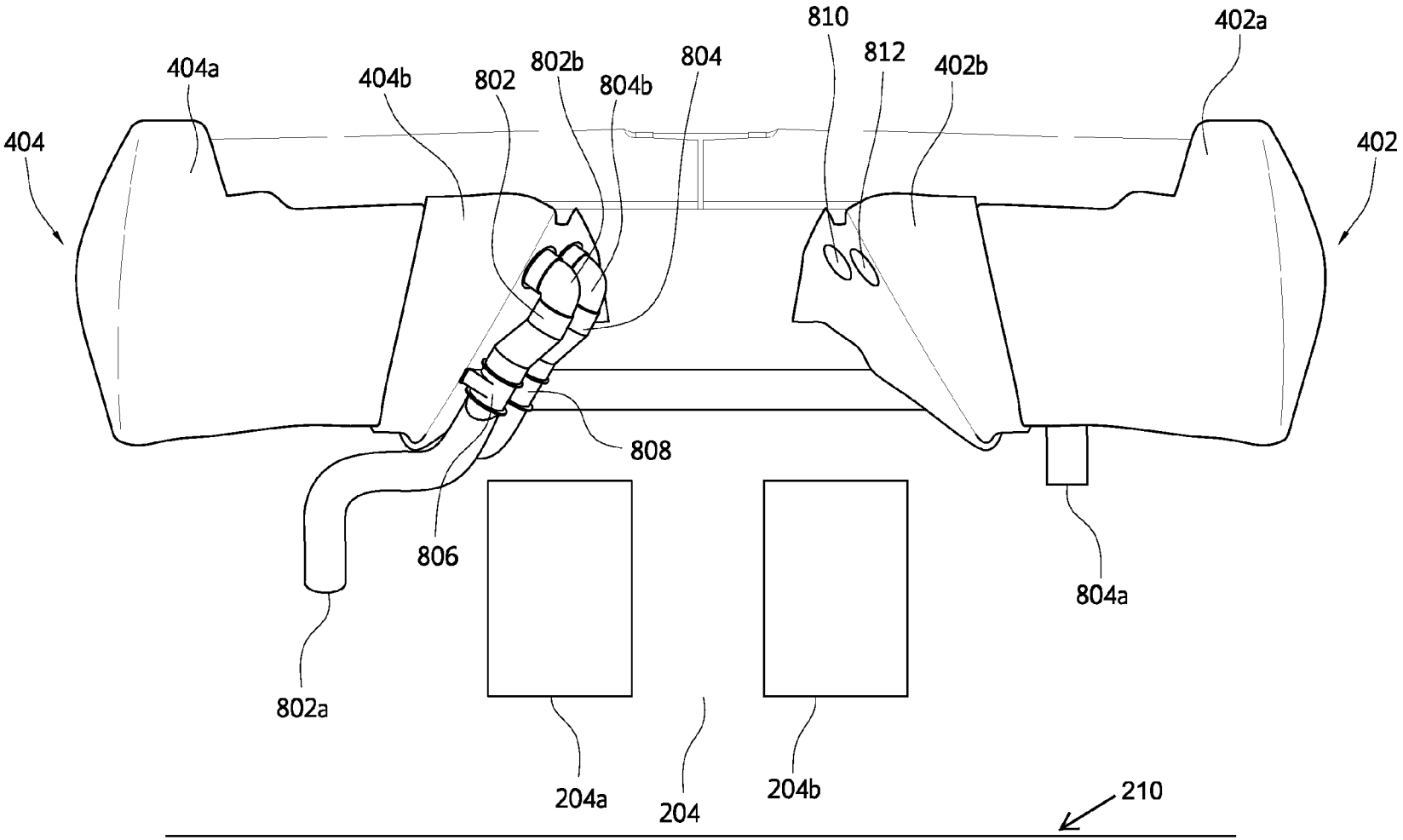
FIG. 8 illustrates a view of the storage compartment taken in a direction from a bow of the watercraft towards the stern of the watercraft.

FIG. 8 is a view from the bow 60 of the watercraft 1 towards the stern 50 of the watercraft 1. A bottom 210 of the engine compartment 202 is illustrated as a straight line, but may be curved. The bottom 210 of the engine compartment 202 may also serve as the keel of the boat 1. Thus, the engine compartment 202 may extend from the keel of the boat 1 to a top of the engine hatch 12. With reference to FIGS. 3 and 8, the drainage area 404*b* may be connected to the engine compartment 202 via conduits 802, 804. Gas may be taken from the engine compartment 202 to the starboard storage compartment 404. Gas may include engine fumes (e.g., petrol fumes, combustion by products from the engine 204, etc.), air or both.

In some embodiments, the conduits 802, 804 are connected to the drainage area 404*b*. As discussed above, in some embodiments, there are no obstructions at an entrance of the drainage area 404*b* as the bottom-most part 414 of the drainage area 404*b* may be below a bottom-most part 600 of the cushion 602, and above or level with a sitting surface 604 of the sitting area 32. Thus, gas may be communicated out of the watercraft 1 through the drainage area 404*b*.

The conduits 802, 804 may be connected to a top part of the drainage area 404*b*. The conduits 802, 804 may be connected to the drainage area 404*b* above the waterline of the watercraft 1 so that water may not be communicated to the engine compartment 202 via the conduits 802, 804.

As illustrated in FIG. 8, the engine 204 may include two engines 204*a*, 204*b*. Each engine 204*a*, 204*b* may be connected and provide a driving force to one of the propulsion units 420, 422. Proximate to each of the two engines 204*a*, 204*b* is an end 802*a*, 804*a* of one of the conduits 802, 804 so that gas may be communicated more efficiently from the engines 204*a*, 204*b*. Each of the ends 802*a*, 804*a* may include an aperture to allow gas to be communicated through the conduits 802, 804. The ends 802*a*, 804*a* may be disposed outside of the engines 204*a*, 204*b* so as to be between the engines 204*a*, 204*b* and the port and starboard sides 34, 36 of the watercraft 1. The ends 802*a*, 804*a* may be disposed directly beneath the storage compartments 402, 404.

The conduits 802, 804 may include other ends 802*b*, 804*b* which are connected to the drainage area 404*b*. The other ends 802*b*, 804*b* may include apertures so that the gas from the engine compartment 202 may be communicated into the drainage area 404*b*.

The port storage compartment 402 may include apertures 810, 812. The apertures 810, 812 may be in communication with the engine compartment 202 such that air from outside the watercraft 1 may be communicated into the engine compartment 202. In some embodiments, the apertures 810, 812 may be formed in a drainage area 402*b* of the port storage compartment 402 to allow air from outside the watercraft 1 to be communicated into the engine compartment 202 via the drainage area 402*b*. The apertures 810, 812 may be formed above the waterline of the watercraft 1 so that water is not communicated into the engine compartment 202 via the apertures 810, 812. In some embodiments, the apertures 810, 812 may be formed directly above the engine 204.

Watercraft blowers 806, 808 may also be included and disposed within, or in communication with, the conduits 802, 804. The watercraft blowers 806, 808 may draw out gas from the engine compartment 202. The watercraft blowers 806, 808 may be controlled and actuated from the controls 14. In some embodiments, the watercraft blowers 806, 808 may be actuated for several minutes prior to actuating the engine 204 so that gas within the engine compartment 202 may be exchanged with fresh air from outside the watercraft 1.

In some embodiments, as the gas is drawn out of the engine compartment 202 via conduits 802, 804 and drainage area 404*b*, gas from outside the watercraft 1 may be drawn into the engine compartment 202 via the drainage area 402*b* and apertures 810, 812. In some embodiments, the watercraft blowers 806, 808 may be disposed outside the conduits 802, 804, but near enough to the conduits 802, 804 to allow the watercraft blowers 806, 808 to draw out gas from the engine compartment 202 via the conduits 802, 804. In some embodiments, the watercraft blowers 806, 808 may be fans.

While two conduits 802, 804 have been illustrated and described above, any number of conduits may be used so long as the gas is drawn from the engine compartment 202. Moreover, the position, size and shape of the conduits 802, 804 may be modified so long as gas is drawn from the engine compartment 202. Furthermore, the two conduits 802, 804 may be attached to the port storage compartment 402, or in addition to, instead of the starboard storage compartment 404. Also, the starboard storage compartment 404 may include apertures disposed directly above the engine compartment 202 and for intake of gas (e.g., fresh air) from outside the watercraft 1 into the engine compartment 202. Moreover, the engine 204 may include any number of engines as long as functions of the watercraft are maintained.

While separate port and starboard storage compartments 402, 404 were described, one large storage compartment may be utilized instead. In such a case, the divider 20 would extend without any division from the port side 34 to the stern side 36 so that one large storage area may be formed which spans across the length of the watercraft 1 from the port side 34 to the stern side 36.

It should be understood, however, that the invention is not necessarily limited to the specific arrangement and components shown and described above, but may be susceptible to numerous variations within the scope of the invention.

It will be apparent to one skilled in the art that the manner of making and using the claimed invention has been adequately disclosed in the above-written description of the preferred embodiments taken together with the drawings.

It will be understood that the above description of the preferred embodiments of the present invention are susceptible to various modifications, changes, and adaptations, and the same are intended to be comprehended within the meaning and range of equivalents of the appended claims.

What is claimed is:

1. A watercraft, comprising:

a cockpit;

a stern-facing seat disposed outside of the cockpit, and having a backrest movable to a first position and to a second position;

an aquatic activity platform extending to a stern of the watercraft from the seat, and defining a foot rest for the seat;

an engine positioned substantially further towards a bow of the watercraft than the seat; and a storage compartment having an opening positioned further towards the bow than the backrest of the seat, the backrest exposing the opening and providing access to the storage compartment when in the first position, and the backrest concealing the opening when in the second position.

2. The watercraft according to claim 1, wherein the storage compartment includes a drainage area for draining liquids, and a storage area for storing equipment and disposed above the drainage area, further wherein in the first position of the backrest, the storage area is exposed to be entirely accessible to a user, further wherein in the second position of the backrest, the backrest completely conceals the storage area so that the storage area is inaccessible to the user.

3. The watercraft according to claim 1, further comprising a wall at least partially enclosing the cockpit, the wall having the opening formed therein, the storage compartment being disposed within the wall.

4. The watercraft according to claim 1, wherein the seat includes a sitting surface for a user to sit upon, further wherein a bottom-most part of the storage compartment is level with or above the sitting surface.

5. The watercraft according to claim 1, wherein the storage compartment includes:

a drainage area that is a bottom-most part of the storage compartment, the drainage area for draining liquids, a storage area above the drainage area, the storage area including a storage section for storing equipment, and a supporting wall disposed between the storage section and the drainage area, the supporting wall having an aperture therein that connects the storage section and the drainage area so that fluid is communicable from the storage section to the drainage area.

6. The watercraft according to claim 5, wherein the drainage area has a bottom-most surface that is at an incline relative to a horizontal direction so that liquid in the drainage area is communicated to an outside of the drainage area.

7. The watercraft according to claim 5, further comprising a conduit for communicating gas between the engine and the drainage area.

8. The watercraft according to claim 7, further comprising an engine compartment that contains the engine, the conduit connecting the engine compartment to the drainage area so that engine fumes from the engine are communicated from the engine compartment to the drainage area via the conduit.

9. The watercraft according to claim 5, further comprising an engine compartment that contains the engine, wherein the drainage area includes apertures for providing fresh air into the engine compartment.

10. The watercraft according to claim 1, wherein the storage compartment is L-shaped so that a length of the storage compartment increases along a direction away from a longitudinal axis of the watercraft.

11. The watercraft according to claim 1, wherein a bottom-most part of the storage compartment is disposed directly above a top-most part of the engine.

12. The watercraft according to claim 1, wherein the backrest includes a cushion for supporting a back of a user, the cushion being movable relative to the storage compartment.

13. The watercraft according to claim 12, wherein the cushion includes a first cushion and a second cushion, the first cushion being movable relative to both of the second cushion and the storage compartment so as to move to the first position to expose the opening of the storage compartment, and move to the second position to conceal the opening of the storage compartment.

14. The watercraft according to claim 1, further comprising a hinge, wherein the backrest is coupled to a sidewall of the storage compartment via the hinge so as to be pivotable relative to the storage compartment, further wherein in the second position, the hinge is disposed closer to a longitudinal axis of the watercraft than the backrest, further wherein the backrest is movable from the second position towards the first position so as to pivot towards the longitudinal axis thereby positioning the backrest closer to the longitudinal axis than the hinge.

15. The watercraft according to claim 1, wherein the aquatic activity platform forms the stern of the watercraft.

16. The watercraft according to claim 1, further comprising an engine compartment containing the engine, the engine compartment being separate from the storage compartment, the engine compartment including an engine hatch and an engine compartment opening, the backrest and the engine hatch being separate and independently movable from each other, the engine hatch being movable to an open position to expose the engine compartment opening so as to provide access to the engine, and a closed position to conceal the engine compartment opening, in the open position of the engine hatch, the engine compartment opening faces towards the bow of the watercraft, in the first position of the backrest, the opening of the storage compartment faces towards the stern of the watercraft.

17. The watercraft according to claim 1, further comprising an engine compartment containing the engine, the engine compartment being separate from the storage compartment, wherein the engine compartment is separate from the storage compartment such that the storage compartment cannot be accessed by a user through the engine compartment.

18. The watercraft according to claim 1, wherein the seat is a first seat and the storage compartment is a first storage compartment, and the watercraft further comprises:

a second seat disposed on an opposite side of a longitudinal axis of the watercraft than the first seat, the second seat being a stern-facing seat and having a second movable backrest, the second seat being outside of the cockpit; and a second storage compartment being separate from the first storage compartment, the second storage compartment having a second opening positioned further towards the bow than the second movable backrest, the engine being positioned substantially further towards the bow of the watercraft than the second seat, the second movable backrest being movable to a first position and to a second position, wherein in the first position of the second movable backrest, the second movable backrest is positioned so as to expose the second opening and provide access to the second storage compartment, in the second position of the second movable backrest, the second movable backrest is positioned to conceal the second opening.

19. The watercraft according to claim 18, further comprising an engine compartment housing the engine, each of the first and second storage compartments includes at the bottom-most part thereof a drainage area that is in fluid communication with an outside of the watercraft, the drainage area of the second storage compartment includes apertures for communicating fresh air to the engine compartment from the outside of the watercraft, the watercraft further comprising:

a conduit for communicating gas between the engine compartment and the drainage area of the first storage compartment; and a blower arranged in the conduit, the blower for drawing the gas from the engine compartment to the outside of the watercraft via the conduit and the drainage area of the first storage compartment, the blower further for drawing fresh air from the outside of the watercraft via the drainage area of the second storage compartment and the apertures.

20. The watercraft according to claim 1, further comprising:

an engine hatch that is movable to an open position to provide access to the engine, and to a closed position to conceal the engine; and controls for controlling operations of the watercraft, wherein the cockpit extends from the engine hatch to the controls.

* * * * *